United States Patent [19]

Fadner et al.

[11] Patent Number: 4,690,055

[45] Date of Patent: Sep. 1, 1987

[54] KEYLESS INKING SYSTEM FOR OFFSET LITHOGRAPHIC PRINTING PRESS

[75] Inventors: Thomas A. Fadner, La Grange; Edward R. Harenza, Chicago; Stanley H. Hycner, Bartlett; Nelson M. Robinson, Naperville, all of Ill.

[73] Assignee: Rockwell International Corporation, Pittsburgh, Pa.

[21] Appl. No.: 901,236

[22] Filed: Aug. 28, 1986

[51] Int. Cl.[4] ..... B41F 7/26; B41F 7/32; B41F 31/04; B41F 31/06

[52] U.S. Cl. ..... 101/451; 101/148; 101/350

[58] Field of Search ..... 101/148, 350, 363, 364, 101/207, 208-210, 355, 356, 360, 450.1, 451, 452

[56] References Cited

U.S. PATENT DOCUMENTS 4,388,864 6/1983 Warner ..... 101/148
4,428,291 1/1984 Dorow ..... 101/350
4,574,695 3/1986 Ryan ..... 101/148

*Primary Examiner*—J. Reed Fisher

[57] ABSTRACT

A keyless inking system for lithographic printing presses wherein an ink/water mixture is contained in an ink pan having a tray portion within which an ink roller is mounted whereby ink/water mixture enters the tray portion on one side and is drawn by the ink roller to the other side of the tray in the nip between the ink roller and a celled metering roller thereby delivering an excess of the mixture to the celled metering roller, the balance of the mixture being conveyed over a weir into a reservoir for continuous mixing and recirculation back to the pan, and wherein the excess ink/water mixture on the metering roller is continuously scraped off by means of a doctor blade and wherein the metered portion of the ink/water mixture remaining in the metering roller's cells is delivered in part into the inking train of a more-or-less conventional lithographic printing press.

12 Claims, 3 Drawing Figures

KEYLESS INKING SYSTEM FOR OFFSET LITHOGRAPHIC PRINTING PRESS

BACKGROUND OF THE INVENTION

In the art and practice of high speed lithographic printing, ink is more or less continuously conveyed from a suitable input device by means of a series of coextensive rollers to a planographic printing plate where the image portions of the printing plate accept ink from one or more of the last of a series of inking rollers and transfers a portion of that ink to a printing blanket as a reverse image from which a portion of the ink is transferred in the form of a right reading image to paper or other suitable substrate. It is also essential in conventional lithographic printing processes that dampening water containing proprietary additives be conveyed more or less continuously to the printing plate where by transferring in part to the non-image areas of the printing plate the water operates to keep those non-image areas free of ink.

In practical printing press systems, the ink is continuously made available in varying amounts determined by cross-press column input control adjustments to all parts of the printing plate, image and non-image areas alike; and in the absence of dampening water, the printing plate will accept ink in both the image and non-image areas of its surface.

Lithographic printing plate surfaces in the absence of imaging materials have minute interstices and an over hydrophilic or water-loving character to enhance retention of water rather than ink on the surface of the plate. Imaging the plate creates oleophilic or ink-loving areas according to the desired format that is to be printed. Consequently, when both ink an water are presented to an imaged plate in appropriate amounts, only that ink tending to reside in non-image areas becomes disbonded from the plate. In its simplest view, this action accounts for the continuous ink and water differentiation at the printing plate surface, which differentiation is essential and integral to the lithographic printing process.

Controlling for the correct amount of dampening water input during lithographic printing has been an industry-wide problem ever since the advent of lithography. Doing so requires continual operator attention since each column adjustment of ink input may require a change in dampener input. Balancing the columner ink input across the width of the press with the non-columner or uniform dampener input across the width of the press is at best a compromise. Consequently, depending upon which portion of the image format the operator has adopted as his standard of print quality at any given time during the printing run, he may need to adjust the ink input at correspondingly-located cross-press positions, which inadvertently also changes the water balance at that position. Conversely, the operator may adjust the dampener input for best ink and water balance in one inking column across the press which action may adversely affect the ink and water balance at one or more other cross-press locations. Adjustments such as these tend to occur repeatedly throughout the whole press run, resulting in slight to major differences in the quality of the printed output throughout the run. In carrying out these adjustment operations, the resulting copies may or may not be commercially acceptable, leading to waste in manpower, materials, and printing machine time.

Means for correcting this inherent fault in conventional lithography have been addressed such as by use of keyless inkers; none have achieved industry-wide success. Certain of these methods also involve eliminating the dampening system or eliminating operator control of the dampening system.

Certain commercially successful newspaper printing configurations rely on the inking train rollers to carry dampening water directly to the printing plate. Notable among these are the Goss Metro, Goss Metroliner, and the Goss Headliner Offset printing presses which are manufactured by the Graphic Systems Division of Rockwell International Corporation. In these alternative configurations, the input dampening water is deposited onto the ink of an inking vibrator drum such that both ink and water are subsequently and continuously transferred to the inking form rollers for deposition onto the printing plate. In another variation, the input dampening water is applied in a more-or-less conventional way directly to the printing plate by means of separate dampening rollers and dampening water input system. In systems of either type, regardless of the method whereby the water is introduced, it is well known that some of the water works its way into the ink and back down through the return-side of the inking train of rollers and may ultimately be introduced into the ink input system itself. In any case, these conventional lithographic systems require considerable operator attention to maintain ink and water balance and they produce more product waste than desired.

Keyless inking systems have been disclosed that purport to eliminate operator attention to column control of inking by elimination of adjustable inking keys and to thereby minimize much of the aforementioned disadvantages of conventional lithography. None of these systems adequately addresses both of the major problems encountered in attempting to control keyless lithographic printing. The first of these is that an ink metering method is required that continues to function despite the presence of up to about 40% water in the ink without allowing temporarily-free water that may appear to interfere with the ink-metering function. Secondly, the unused or non-uniform portion of the ink film that is being continuously presented to the printing plate must be continuously scraped-off the return side of the inking system to enable continuous presentation of the uniform ink film to the plate by the input side of the inker. This scraped-off film is not uniform in ink and water composition. Since it would not be economically feasible to continuously discard the unused ink and that ink/water mixture must be homogenized either by selectively removing water from the mixture and returning it to the inking system or by thoroughly intermixing the unused ink with fresh replenishment ink and returning the mixture to the inking system. We have found that water removal is unnecessary and in the present invention means is provided to accommodate the dampening water that is naturally acquired in the unused ink during the practice of more-or-less conventional lithographic printing and thereby achieve simplified keyless inking control capability heretofore not practical or possible.

DESCRIPTION OF THE PRIOR ART

Warner in U.S. Pat. No. 4,287,827 describes a novel printing press system for using an inking roller that is manufactured to have bimetal surfaces for instance, chromium and copper, which different roller surfaces are claimed to simultaneously carry dampening solution and ink, respectively, to the form rollers of a simplified inking system. Warner thereby avoids the necessity for an independent dampening system of rollers. However, the Warner technology does not specify continual removal of unused ink and water mixture from the inking train of rollers, which is a distinct departure from the present invention.

A number of celled or recessed or analox type ink metering rollers have been described in trade and technical literature. The American Newspaper Publishers Association (ANPA) describes in U. S. Pat. No. 4,407,196 a simplified inking system which uses chromium or hardened steel or hard ceramic materials like tungsten carbide and aluminum oxide as the metering roller. These hard materials are advantageously used to minimize roller wear in a celled ink metering roller inking system operating with a continuously scraping coextensive doctor blade.

Another patent relating to the use of a keyless ink system in which water is present in the ink is U.S. Pat. No. 4,527,479 by H. Dahlgren. In this arrangement, a portion of the excess ink and water mixture unused by the printing plate is continuously removed from the system by means of a rider roller that is in contact with an ink form roller which is in turn in contact with the printing plate. The ink and water mixture that is scraped from the rider roller is returned to a reservoir which acts as the primary source of the input ink/water mixture.

SUMMARY OF THE INVENTION

In the present invention, location of the dampening system is not critical and can be positioned either to supply water directly to the plate cylinder or at some other location such as at a vibrator drum to which ink is also being supplied. Provided is an ink circulating and mixing system which receives both new or replenishment ink and the ink and water combination that is continuously returned from a scraper blade located on a celled metering roll. The ink circulating and mixing system functions to assure an inherently uniform cross-press ink and water ratio that remains consistent throughout and this system consists of an ink pan, pump and appropriate conduits, an ink pan level controlling system, and an ink reservoir of such volume and design that it assures the ink being fed to the metering roller is uniform in water content and composition at any given instant of time despite the existence of the continual cross-press water-to-ink ratio differences of the unused or scraped ink previously referred to. The ink circulation system is designed to continuously collect and distribute the ink and water mixture from the reservoir through a plenum or series of orifices directed to uniformly redistribute the ink and water mix across the press width thereby assuring instantaneously uniform water content of the ink that is being introduced to the metering roller. The metering roller can be one of the type shown and described in U.S. Pat. Nos. 4,537,127, 4,567,827, and 4,601,242, to Fadner, or any hard oleopohilic/hydrophobic roller as substantially therein defined, all of which are assigned to the same assignee as the present application.

It is therefore a principal object of this invention to provide a simplified lithographic printing system having fewer materials controls than are required in prior art lithographic and planographic systems.

An additional object of this invention is to provide a keyless means for conveying ink that contains natural quantities of dampening water to a more-or-less conventional lithographic printing plate in quantities appropriate for proper image differentiation at the printing plate.

It is a further object of this invention to provide a novel ink-pan and ink-recirculating-system that functions to assure that the water content in the ink is maintained in a thoroughly homogenized condition thereby negating buildup of free water anywhere in the inking system which would result in debonding of the ink from the metering roller or inking rollers or printing plate image areas.

These and other objects and advantages of the invention will be in part obvious and in part explained by reference to the accompanying specifications and drawings in which.

DESCRIPTION OF THE PREFERRED EMBODIMENT

Figure 1:
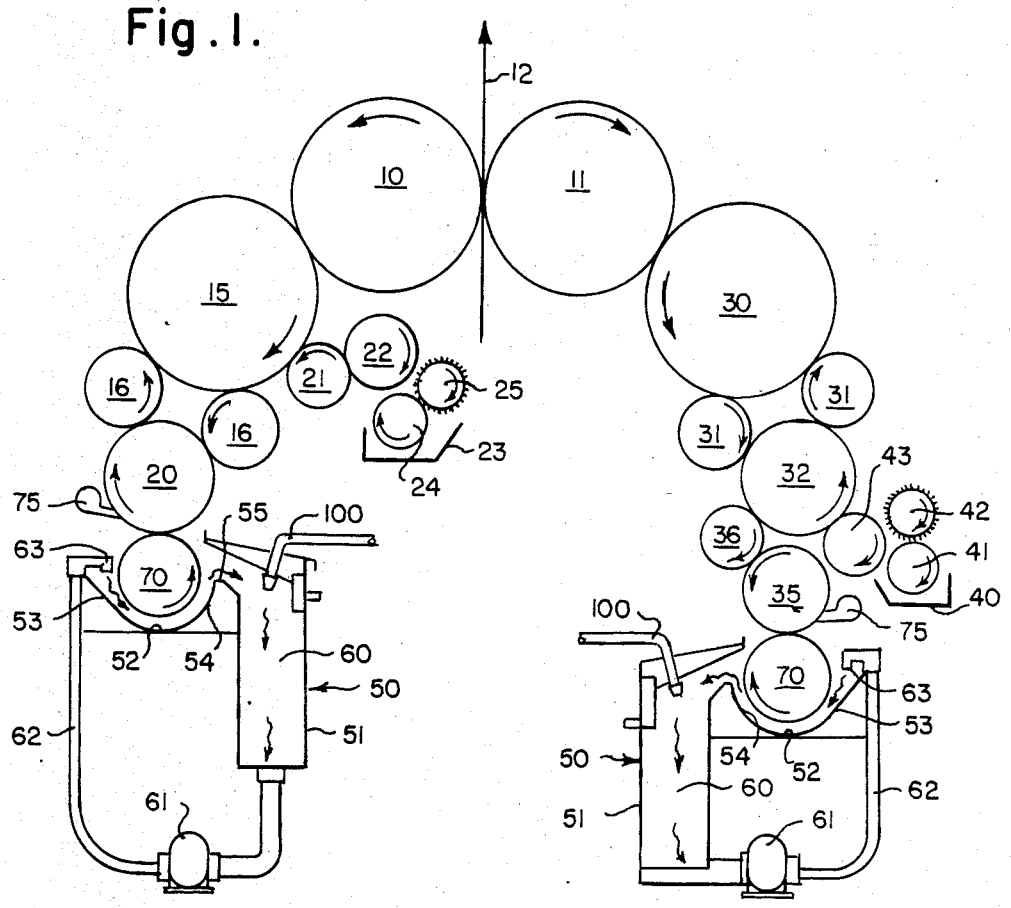
FIG. 1 is a schematic side elevation of a press utilizing the improved inking system of this invention and showing alternative locations where water can be supplied to the system.

To more clearly understand the invention reference is made to the drawings and more particularly to FIG. 1 in which numerals 10 and 11 represent the left and right hand blanket cylinders that together cooperate to print on a web traveling therebetween as indicated by the directional arrow 12. The plate cylinder, inking system, and fluid dampening systems associated with blanket cylinder 10 are arranged somewhat differently from those associated with blanket cylinder 11. The selection as to which arrangement is to be used is a matter of choice since both are relatively conventional in their makeup. Referring first to the remainder of the dampening and inking systems associated with blanket cylinder 10, the plate cylinder 15 is contacted by two ink form rollers 16 which are in turn contacted by a celled metering roller 20. The celled metering roller 20 is preferably of the type described and claimed in U.S. Pat. Nos. 4,537,127, 4,567,827 and 4,601,242 which were cited previously. In the dampening arrangement associated with plate roll 15 there is provided a rubber form roller 21 and a copper covered or Rilsan covered oscillating transfer roller 22. The water is contained in a pan tray 23 and a pan roller 24 is used to pick up water from the pan 23 to bring it into contact with a spiral brush roller 25 that is rotating in a direction opposite to the direction of rotation of pan roller 24. It should be recognized that virtually any known dampening system can be used in similar manner.

Figure 3:
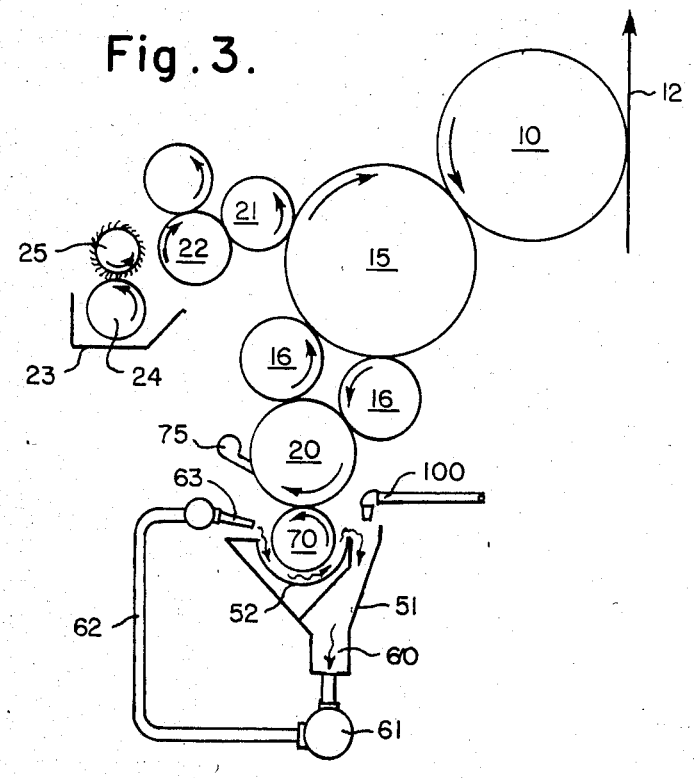
FIG. 3 is a side elevation showing the improved ink pan and circulating system similar to the construction illustrated on the left side of FIG. 1, excepting a water-last dampening system employing an inked set of damper rollers is depicted, which number and type of rollers functions to avoid the usual water-interference effects of water-last dampening.

With this or other input arrangement water is transferred onto the transfer roller 22 and from there to the dampener form roller 21. The form roller 21 is positioned in a water-first sequence so that, during each revolution of press, plates are first subjected to water from the dampener form roller 21 before ink is applied to the surface of the plates by means of the rubber covered ink form roller. An alternative water-last dampening configuration is depicted in FIG. 3.

In the arrangement shown in the right side of FIG. 1 of the drawings the blanket cylinder 11 is in contact with plate cylinder 30 and this is in turn contacted by rubber form rollers 31. In this arrangement ink is supplied to a vibrator drum 32 by means of a celled metering roller 35 which is of the same type as the metering roll 20 and this roller in turn transfers a metered quantity of ink to a rubber covered transfer roller 36. As clearly shown in the drawing, roller 36 is in contact with the copper vibrator drum 32 so that ink is deposited thereon. Dampening water is applied to the vibrator drum 32 in much the same manner as water was supplied in the arrangement shown in the left side of the FIG. 1 drawing. For instance, a water pan 40 contains a pan roller 41 that is contacted by a counter rotating spiral brush roll 42 that flicks water onto the water transfer roller 43. Transfer roller 43 is in contact with the vibrator drum 32 so that the drum then carries both water and ink to the transfer rolls 31 thence to the printing plate. Other dampening water input means can be used and the spiral brush method is indicated here only for illustrative purposes.

The most significant part of the present invention is the inking system that is used to supply ink to the plate and blanket cylinders. This system, makes it possible to supply a uniform mixture of ink and water to the printing plate and thereby maintain the high print quality characteristic of conventional lithography. In this arrangement the inking system is identified generally by the numeral 50 and is used to deliver this uniform mixture of ink and water to the celled metering rollers 20 and 35. Water in this system is not deliberately added to the ink but rather results naturally from water picked up by the ink contacting the printing plate and which by means of the return or unused portion of that ink passes or transfers backward down through the various form and metering rollers eventually entering the ink reservoir. The inking arrangement comprises an ink pan 51 that includes a tray portion 52 for holding the combined ink and water mixture in proximity to the pan roller. The tray portion is made up of a first longitudinally extending wall 53 that defines the ink input side of the tray and a second longitudinally extending wall 54 that has a wall area of lower height than the first wall area 53. The second or exiting wall area of lower height defines an outflow weir 55 that determines the depth of the ink and water mixture contained in the tray portion 52.

Figure 2:
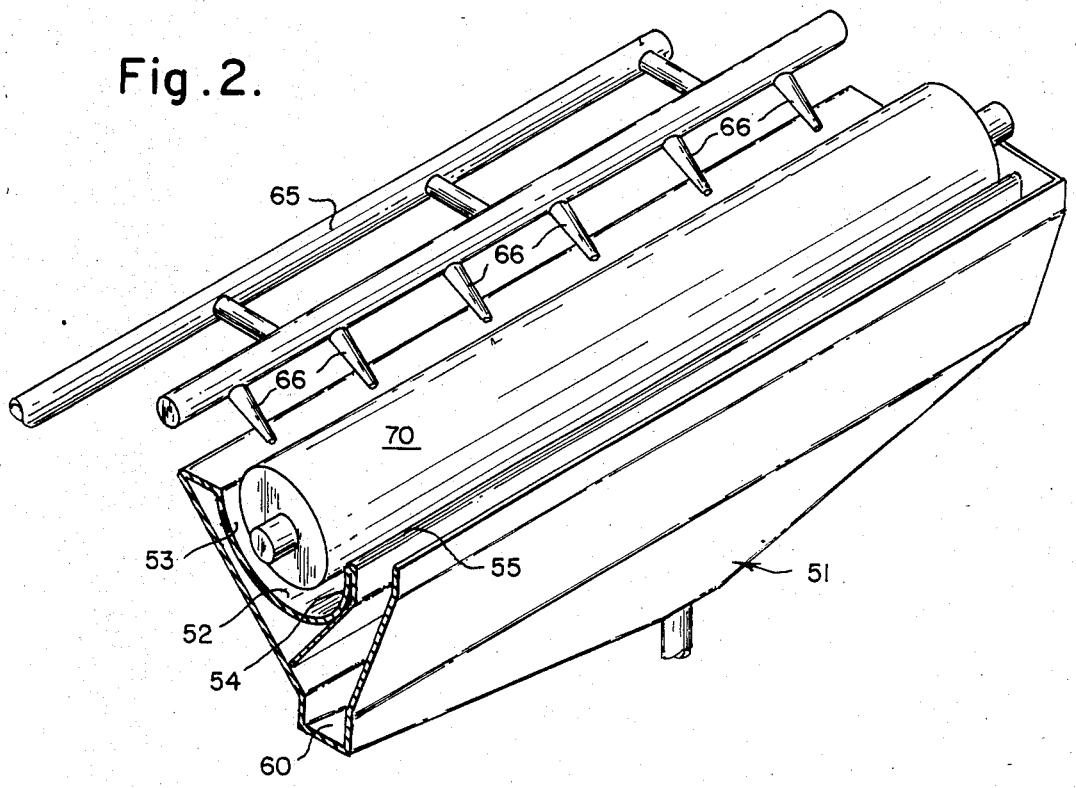
FIG. 2 is a perspective view of the improved ink pan and ink roll portion of this invention showing the pan partially in section.

Adjacent to and formed integrally with the tray portion 52 is a reservoir or sump portion 60 that must contain from about 5 to about 30 gallons of operating ink volume. A minimum volume is essential to help maintain consistent ink composition despite continual or intermittent relatively small additions of scraped-off ink containing water and of fresh or replenishment ink to the pan 51. As can best be seen in FIG. 2 of the drawings, the reservoir portion of the ink pan assembly is designed to help assure that all of the ink and ink and water mixture in the reservoir flows readily toward the reservoir drain. Pumping means 61 is connected to the bottom of reservoir 60 and has a circulation pipe 62 which leads to orifices or nozzles 63 that are mounted to introduce the circulating ink and water mixture into the input side of the tray portion 52 along the entire width thereof. As can be seen in FIG. 2, the circulation pipe 62 may be connected to a manifold 65 that in turn feeds the plurality of nozzles 66 that are disposed along the entire width of the tray portion 52.

Mounted within the tray portion 52 is a rubber-covered pan roller 70 that rotates in the direction indicated in FIG. 1 of the drawings so that it tends to convey the ink and water mixture introduced on the inflow side of the tray portion toward the outflow weir 55, while at the same time delivery a portion of the ink and water mixture to the nip between pan roller 70 and metering rollers 20 and 35. As the drawings indicate the pan roller 70 is located a predetermined distance from the wall portion 53 and 54 so as to increase the pumping action of the pan roller, thereby moving the ink and water mixture through the tray portion. Preferably metering rollers 20 and 35 are in positive interference with the pan roller so that the flat portion of the nip formed by this positive interference ranges from about $\frac{1}{8}''$ to $\frac{1}{2}''$. In actual construction is preferred that the tray portion be defined by a bottom wall that has an arcuate shape that substantially conforms to the curvature of the outer surface of the pan roller, although obviously this exact configuration is not necessary in all instances.

Another element of the overall apparatus is the provision of a scraping blade 75 which preferably is made of prehoned Swedish spring steel and is advantageously mounted against the upward rotary side of the metering roller 20 and 35. During operation it is preferred that the blade make an angle with the tangent to the metering roller of 30° plus or minus 5°. This specification is critical to efficiency of scraping action and not to the spirit of the invention. The blade, metering roller and pan roller must be mounted such that the continuously scraped off unused ink (containing water picked up by the ink at the plate) falls directly and cleanly into the pan in such a manner that all of the scraped off ink and water mix is continuously and rapidly assimilated into the circulation system ink flow. This may advantageously be accomplished by having the scraped-off ink and water mixture fall directly into the input side of the space formed between the concentric ink pan element and the ink pan roller. As noted above, the positional relationship between the blade, the metering roll, and the pan roller is important to efficient operation of this system and in this regard the metering roller and the pan roller should be disposed in such a way wherein the axis of rotation of the pan roller lies in a plan not more than about 30° from a plane passing vertically through the axis of the metering roll.

In operation the system may initially be supplied by means of fresh input device 100 with ink containing no water and the printing operation commences by having the ink pan roller 70 delivering ink to the metering rollers 20 and 35 which then deliver ink onto the transfer, vibrator, and form rollers according to the configuration being used, which ultimately delivers the ink to the printing plate mounted on the plate cylinder. As operation of the apparatus continues water is picked up by the ink and is gradually returned to the ink pan roller through the inking train and a gradual increase of water present in the inking system occurs. In this regard it is important that the reservoir contain an amount of ink ranging from about 5 to 30 gallons so that the percentage of water content in the ink never builds up to more than about 40%. Water contents higher than this generally will exceed an ink's capacity to convey water as a mixture on the inking rollers during operation. During operation fresh ink containing no water is added by input device 100 to the reservoir 60 to make up for ink used up in the printing process. Although important to the operation of this invention, it is apparent that any of the fluid level maintaining devices which are known in the art can be used to maintain the operating volume of ink pan fluid within the necessary limits. Consequently no particular device is specified in this disclosure.

It should be appreciated that other and further embodiments of the invention may be devised without departing from the basic concept thereof.

The invention having been described, what is claimed is:

1. In an offset lithographic printing press having blanket cylinder, plate cylinder with printing mounted thereon, form cylinders, and a system for supplying dampening water to the printing plate an improved inking system comprising:

A. ink pan means for holding and circulating an ink and water mixture including:

(i) a tray portion having a first longitudinally extending wall area defining the ink input side of said tray and having a second longitudinally exiting wall area defining the ink input side of said tray having a second longitudinally exiting wall area of lower height than first wall area which defines an outflow weir that determines the depth of the ink and water mixture in said tray portion;

(ii) a reservoir portion adjacent said tray portion to receive the ink and water mixture flowing from said tray portion over said outflow weir;

(iii) means for introducing ink and water into the input side of said tray portion along the entire length thereof;

(iv) pump means connected to said reservoir portion and to said ink and water mixture introducing means to circulate the mixture therebetween;

(v) means for introducing fresh replacement ink for that used by the printing process;

B. a pan roller mounted within said tray portion and having an outer compressible, oleophilic surface that is spaced from said first and second longitudinal wall areas a distance such that rotation of said pan roller causes flow of ink or an ink and water mixture toward said outflow weir;

C. a hard oleophilic and hydrophobic celled metering roller mounted above said pan roller and in positive interference therewith to receive ink and ink and water mixture from said pan roller and deliver it to inking form roller;

D. scraping blade mounted for contact with said celled metering roller at a location causing excess ink and water mixture to be returned to said tray portion in the area defining the ink and water mixture input side of said tray portion; and E. an ink level measuring device operating on the ink pan contents to actuate the means for replenishing ink used up during operation.

2. An improved inking system as defined in claim 1 wherein said tray portion is defined by a bottom wall having an arcuate shape substantially conforming to the curvature of the outer surface of said pan roller.

3. An improved inking system as defined in claim 1 wherein the positive interference between said pan roller and said celled metering roller ranges from about $\frac{1}{8}''$ to $\frac{1}{2}''$ as measured by the roller stripe defined by the nip formed by the two said rollers.

4. An improved inking system as defined in claim 1 wherein said reservoir portion is of a volume that maintains the amount of water in the ink and water mixture at a water content of not more than about 40%.

5. An improved inking system as defined in claim 1 wherein said means for introducing the ink and water mixture into the input side of said tray portion comprises a supply manifold having a plurality of outlets along the length of said tray.

6. An improved inking system as defined in claim 1 wherein said scraping blade is mounted against the upward rotary side of said celled metering roller at an angle with respect to a line tangent to said metering roll of $30° \pm 5°$.

7. An improved inking system as defined in claim 2 wherein the said bottom wall of said tray portion is spaced from said pan roller a distance of from about $\frac{1}{4}''$ to $1''$.

8. An improved inking system as defined in claim 1 wherein the axis of rotation of said pan roller lies in a plane not more than 30° from a plane passing vertically through the axis of said metering roll.

9. An improved inking system as defined in claim 1 wherein said reservoir portion holds between 5 and 30 gallons of ink and water mixture.

10. A process for supplying a homogenous mixture of ink and dampening fluid to the plate of a lithographic printing press comprising the steps of:

A. providing an ink and dampening fluid reservoir having a shallow tray portion provided therein, B. disposing a pan roller adjacent the tray portion so that rotation thereof causes ink and dampening fluid mixture to be conveyed on the surface of said roller, thereby to be pumped through the tray, C. disposing a celled metering roller in contact with said pan roller so that the ink and dampening fluid mixture is in part forced by the pan roller into the cells of the metering roller, D. returning to the reservoir that portion of the ink and dampening fluid mixture that is pumped through the tray portion and is not taken by the metering roller and conveyed to an inking form roller to be used for printing, E. collecting the unused ink and dampening fluid mixture in the reservoir, pumping it through a circulating system and thereby returning the ink and dampening fluid mixture to the shallow tray, and F. scraping excess ink and dampening fluid mixture from the celled metering roll in a manner that it is returned to the tray portion on the intake side of the pumping action caused by the pan roller and thereby conveying ink dampening fluid mixture to further inking roller and to the printing plate in an amount corresponding to the cells impressed in said metering roller.

11. The process as defined in claim 10 wherein the ink and dampening fluid mixture is pumped into the tray portion along the entire length thereof.

12. The process as defined in claim 10 wherein the percentage of dampening fluid in the ink does not exceed more than about 40%.

* * * * *

UNITED STATES PATENT AND TRADEMARK OFFICE

CERTIFICATE OF CORRECTION

PATENT NO. : 4,690,055

DATED : Sep. 1, 1987

INVENTOR(S) : Fadner et al.

It is certified that error appears in the above—identified patent and that said Letters Patent is hereby corrected as shown below:

ON THE TITLE PAGE:

[21] After "Appl. No.:" delete '901,236' and insert --901,238--

Column 7, Line 15 After "printing" insert --plate--

Signed and Sealed this

Second Day of February, 1988

*Attest:*

*Attesting Officer*

DONALD J. QUIGG

*Commissioner of Patents and Trademarks*

US004690055B1

REEXAMINATION CERTIFICATE (1650th)

United States Patent [19]

Fadner et al.

[11] B1 4,690,055

[45] Certificate Issued Mar. 3, 1992

[54] KEYLESS INKING SYSTEM FOR OFFSET LITHOGRAPHIC PRINTING PRESS

[75] Inventors: Thomas A. Fadner, La Grange; Edward R. Harenza, Chicago; Stanley H. Hycner, Bartlett; Nelson M. Robinson, Naperville, all of Ill.

[73] Assignee: Rockwell International Corporation

Reexamination Request:
No. 90/001,913, Dec. 22, 1989

Reexamination Certificate for:

| | |
|---|---|
| Patent No.: | 4,690,055 |
| Issued: | Sep. 1, 1987 |
| Appl. No.: | 901,236 |
| Filed: | Aug. 28, 1986 |

[51] Int. Cl.[5] ..... B41F 7/26; B41F 31/06; B41F 7/32; B41F 31/04

[52] U.S. Cl. ..... 101/451; 101/148; 101/350

[58] Field of Search ..... 101/148, 350, 207, 208-210, 101/363, 364, 355, 356, 360, 450.1, 451, 452

[56] References Cited

U.S. PATENT DOCUMENTS

| | | | |
|---|---|---|---|
| 3,585,932 | 6/1971 | Granger | 101/169 |
| 4,287,827 | 9/1981 | Warner | 101/141 |
| 4,388,864 | 6/1983 | Warner | 101/148 |
| 4,407,196 | 10/1983 | Matalia | 101/142 |
| 4,428,291 | 1/1984 | Durow | 101/350 |
| 4,527,479 | 7/1985 | Dahlgren | 101/148 X |
| 4,537,127 | 8/1985 | Fadner | 101/348 X |
| 4,567,827 | 2/1986 | Fadner | 101/350 X |
| 4,574,695 | 3/1986 | Ryan | 101/148 |
| 4,601,242 | 7/1986 | Fadner | 101/348 |

FOREIGN PATENT DOCUMENTS 58-218291 5/1985 Japan .

*Primary Examiner*—J. Reed Fisher

[57] ABSTRACT

A keyless inking system for lithographic printing presses wherein an ink/water mixture is contained in an ink pan having a tray portion within which an ink roller is mounted whereby ink/water mixture enters the tray portion on one side and is drawn by the ink roller to the other side of the tray in the nip between the ink roller and a celled metering roller thereby delivering an excess of the mixture to the celled metering roller, the balance of the mixture being conveyed over a weir into a reservoir for continuous mixing and recirculation back to the pan, and wherein the excess ink/water mixture on the metering roller is continuously scraped off by means of a doctor blade and wherein the metered portion of the ink/water mixture remaining in the metering roller's cells is delivered in part into the inking train of a more-or-less conventional lithographic printing press.

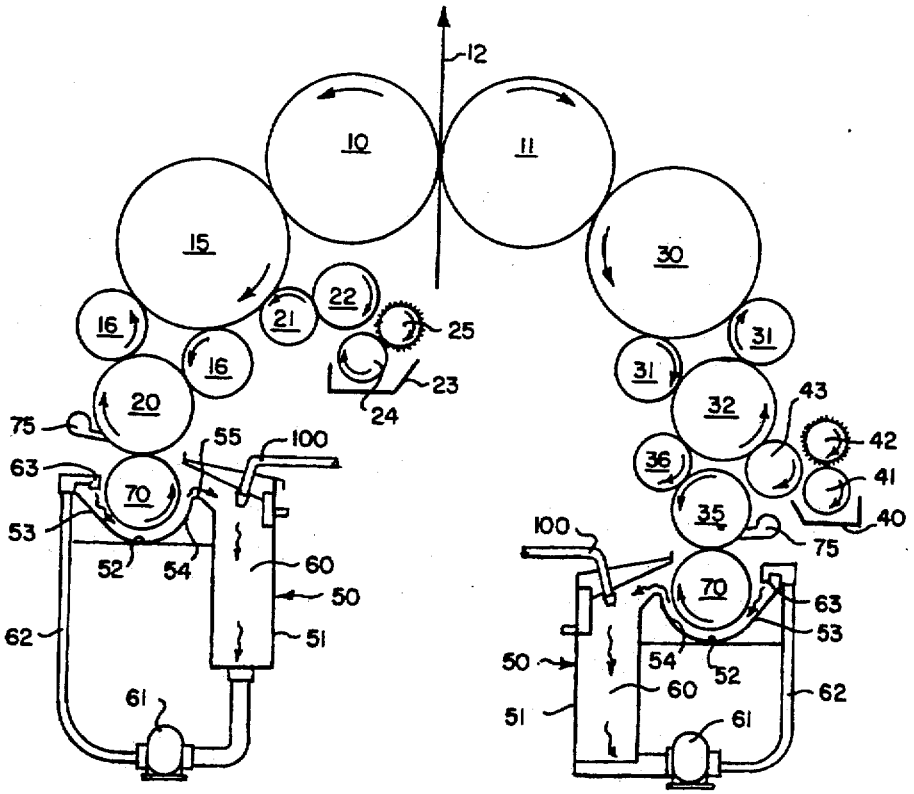

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-12 are cancelled.

* * * * *